US008627781B2

(12) United States Patent
Ishizu et al.

(10) Patent No.: US 8,627,781 B2
(45) Date of Patent: Jan. 14, 2014

(54) COATING DIE AND COATING APPARATUS COMPRISING THE SAME

(75) Inventors: Seiji Ishizu, Toyota (JP); Shigemitsu Nomoto, Nisshin (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 131 days.

(21) Appl. No.: 13/258,536

(22) PCT Filed: Mar. 30, 2009

(86) PCT No.: PCT/JP2009/056463

§ 371 (c)(1), (2), (4) Date: Sep. 22, 2011

(87) PCT Pub. No.: WO2010/116442

PCT Pub. Date: Oct. 14, 2010

(65) Prior Publication Data

US 2012/0017827 A1 Jan. 26, 2012

(51) Int. Cl.

*B05C 3/02* (2006.01)
*B05C 3/12* (2006.01)
*B05D 3/12* (2006.01)

(52) U.S. Cl.

USPC ..... 118/410; 118/413; 118/419; 427/356

(58) Field of Classification Search

USPC ..... 118/326, 410, 413, 419, 426, 429
See application file for complete search history.

(56) References Cited

U.S. PATENT DOCUMENTS 3,025,828 A * 3/1962 Heilman ..... 118/419
3,599,602 A * 8/1971 Krautzberger et al. ..... 118/50
4,405,661 A * 9/1983 Alheid ..... 118/410
4,945,855 A * 8/1990 Eklund et al. ..... 118/407
5,597,615 A * 1/1997 Tsunoda et al. ..... 118/410
2006/0260542 A1* 11/2006 Neuhaus ..... 118/326

FOREIGN PATENT DOCUMENTS

| | | |
|---|---|---|
| JP | 2-91678 | 7/1990 |
| JP | 5-261334 | 10/1993 |
| JP | 10-151394 | 6/1998 |
| JP | 10-323604 | 12/1998 |
| JP | 2000-279865 | 10/2000 |
| JP | 2001-293416 | 10/2001 |
| JP | 2002-86040 | 3/2002 |
| JP | 2003-88791 | 3/2003 |
| JP | 2007-98334 | 4/2007 |
| JP | 2007-105672 | 4/2007 |
| JP | 2008-86990 | 4/2008 |
| JP | 2008-188501 | 8/2008 |

OTHER PUBLICATIONS

International Search Report in International Application No. PCT/JP2009/056463; Mailing Date: Jun. 9, 2009.

* cited by examiner

*Primary Examiner* — Dah-Wei Yuan
*Assistant Examiner* — Binu Thomas
(74) *Attorney, Agent, or Firm* — Finnegan, Henderson, Farabow, Garrett & Dunner, LLP

(57) ABSTRACT

Disclosed is a coating die which can recover a coating solution to be wasted in a good manner, while suppressing adhesion of foreign matter onto an object to be coated. A coating apparatus comprising the coating die is also disclosed. Specifically disclosed is a coating die (30) for coating a web (2) with a paste (3), which comprises a main body (31) having a discharge opening (31*e*) for discharging the paste (3) upwardly, a recovery pan (32*c*) for recovering the paste (3) flowing out from the discharge opening (31*e*), and flow passage (grooves (32*a*, 32*a*) and shoots (32*b*, 32*b*)) which are integrally formed with the main body (31) for the purpose of guiding the paste (3) from the discharge opening (31*e*) to the recovery pan (32*c*).

1 Claim, 7 Drawing Sheets

COATING DIE AND COATING APPARATUS COMPRISING THE SAME

TECHNICAL FIELD

The present invention relates to a coating die and a coating apparatus with the coating die.

BACKGROUND ART

As to a conventional coating apparatus that has a coating die for coating a coating solution (paste) on a sheet (web), it is common way to fill up the paste in the discharge path of the coating die in order to remove air from the path, before coating with the coating die. If this deaeration process is not completely done, the paste contains the air and there are bubbles in the coated surface, thereby leading the coating defect.

When filling up the paste and removing the air, the paste is continuously discharged and the paste flows down from the discharge opening of the coating die. If the paste flows into the other devices located around the die, the paste may cause the failure thereof. If the paste is dried off around the discharge opening of the die, the dried-out paste may be attached to the web as a foreign matter and lead the coating defect.

Especially if the web (object to be coated) is an electrode web used in a battery, a foreign matter would be contained in the battery, and may occur defects such as an internal short-circuit.

To solve the above-mentioned problems, it is required for the coating apparatus to provide a good recovery of the paste that is flowed down when filling up the paste and deaerating for the ready-to-coat.

For instance, JP 2003-88791 A discloses a coating apparatus which has a nozzle for coating and the nozzle is connected with a paste storage via a capillary passage, and in which the paste storage has an opening in the vicinity of discharge openings of the nozzle. Due to the structure, the paste flowed down from the discharge openings can be recovered by the storage.

However, the coating apparatus of JP 2003-88791 A uses the capillary action for coating, so that the fine adjustment of the coating condition, such as the distance between the nozzle and the web or the discharging volume, is difficult and therefore the coating defect may be easily occurred. Especially, in such a case that the thin and even paste layer needs to be formed on the web, the fine adjustment is important. Thus, there is a limit to use the technique disclosed in JP 2003-88791 A.

Further, the paste discharged from the discharge openings is recovered to the paste storage, which can improve the usability of the paste, but the foreign matter (grit and dust) may be mixed in the paste during the recirculation. When the paste is coated on the electrode web of the battery, the foreign matter occurs the defect, so that the coating solution is preferably recovered as the waste, or recovered and processed for reuse, whereby the technique of JP 2003-88791 A is not applicable.

Citation List

Patent Literature

PTL 1: JP 2003-88791 A

SUMMARY OF INVENTION

Technical Problem

The objective of the present invention is to provide an unexpected coating die and a coating apparatus containing the coating die, which is capable of recovering a coating solution to be wasted and of preventing foreign matter from attaching to an object to be coated.

Technical Solution

The first aspect of the present invention is a coating die for coating an object to be coated with a coating solution. The coating die includes: a main body having a discharge opening for discharging the coating solution upwardly; a recovery container for recovering the coating solution flowed down from the discharge opening; and a flow passage formed integrally with the main body, guiding the coating solution to the recovery container.

In the advantageous embodiment of the present invention, the flow passage includes: a groove having a bottom, formed around the discharge opening, inclined toward a predetermined position; and a shoot having a bottom, formed continuously from the groove, discharging the coating solution guided along the groove to outside of the groove.

In the preferable embodiment of the present invention, the coating die further includes adjusting means for adjusting a distance between the discharge opening of the main body and the object to be coated.

The second aspect of the present invention is a coating apparatus including the coating die of the first aspect of the coating die. The coating apparatus includes: a conveyor for conveying the object to be coated continuously, with the surface thereof facing to the discharge opening of the coating die; and a supporter for supporting the coating die movable within a state where the coating die faces to the surface of the object to be coated and a state where the coating die is separated from the object to be coated.

Advantageous Effects of Invention

According to the first and second aspect of the present invention, it is provided that the coating die and the coating apparatus, both of which are capable of recovering the coating solution to be wasted and of preventing foreign matter from attaching to the object to be coated.

REFERENCE SIGNS LIST

Figure 1:
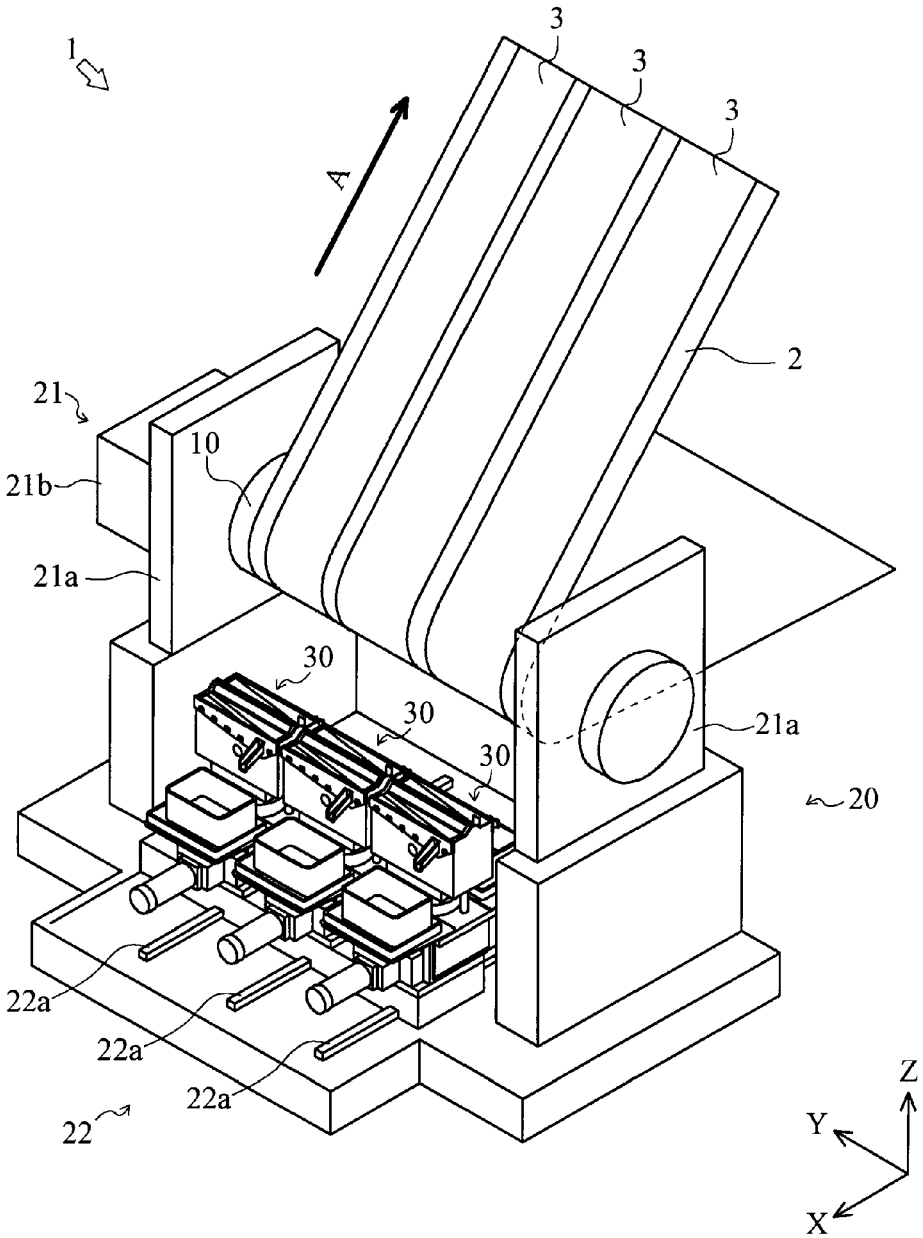
FIG. 1 is a perspective view of a coating apparatus.

1: coating apparatus
2: web (object to be coated)
3: paste (coating solution)
10: back-up roller (conveyor)
20: support table (supporter)
30: coating die
31: main body

31*e:* discharge opening
32*a:* groove (flow passage)
32*b:* shoot (flow passage)
32*c:* recovery pan (recovery container)
33: elevator device (adjusting means)

DESCRIPTION OF EMBODIMENTS

Referring to FIGS. 1 to 6, the structure of a coating apparatus 1 is described. For convenience of explanation, a front-back direction, a right-left direction and an upper-lower direction are defined by the X-arrow, the Y-arrow and the Z-arrow in FIG. 1 directing the front, right and upper, respectively.

The coating apparatus 1 is used for coating a paste 3 on the surface (to be coated) of a web 2 that is an object to be coated.

The web 2 is a sheet member such as a paper, a plastic film, a metal foil, a rubber sheet or a textile, and is continuously conveyed to the coating apparatus 1 with a conveyor. In this embodiment, the web 2 is an electrode web (metal foil) of a battery.

The paste 3 is an oil-based or a water-based solution to be coated on the web 2. In this embodiment, the paste 3 is an electrode compound paste containing electrode active materials.

As depicted in FIG. 1, the coating apparatus 1 includes a back-up roller 10, a support table 20 and multiple coating dies 30.

As to the coating apparatus 1, the back-up roller 10 conveys the web 2 continuously, and the three coating dies 30 mounted on the support table 20 apply the paste 3 on the web 2 in three stripes.

The back-up roller 10 continuously conveys the web 2 in a predetermined conveying direction (the arrow A direction in drawings) that is wound off from a roll (not shown), and the roller gives a predetermined tension (so that the web 2 is not wound down).

As shown in FIG. 1, the roller 10 supports the back surface of the web 2 (opposite surface to the surface to be coated), and conveys the web 2 with the surface to be coated faced to the coating dies 30. The roller 10 is rotated at a predetermined speed, so that the web 2 is conveyed in the rotation direction of the roller 10.

The support table 20 supports the back-up roller 10 rotatably, and includes a rotation device 21 for driving the roller 10 and a sliding device 22 for supporting and moving the coating dies 30.

As shown in FIG. 1, the rotation device 21 includes supporters 21*a* for supporting the back-up roller 10 and an electric motor 21*b* for rotating the roller 10.

The supporter 21*a* contains a bearing, which rotatably supports the shaft of the roller 10.

The electric motor 21*b* is configured as the high-accurately controlled motor, and the output shaft thereof is connected to the shaft of the roller 10. The motor 21*b* drives the roller 10 at the predetermined speed. The motor 21*b* is disposed at one of the supporters 21*a*.

Thus, the roller 10 is supported by the supporters 21*a* and driven by the motor 21*b*, and the roller is rotated at the predetermined speed.

As shown in FIG. 1, the sliding device 22 supports and locates the coating dies 30 at a set position in the front-back direction (that is the direction perpendicular to the shaft of the back-up roller 10).

More specifically, the sliding device 22 includes sliding guides 22*a* aligned in the front-back direction and a driving device for driving the sliding device 22 so as to move the coating dies along the sliding guides 22*a*.

As shown in FIG. 1, the coating dies 30 are aligned in the left-right direction (that is the shaft direction of the back-up roller 10), spaced at a predetermined interval each other, and the coating dies move integrally.

Figure 2:
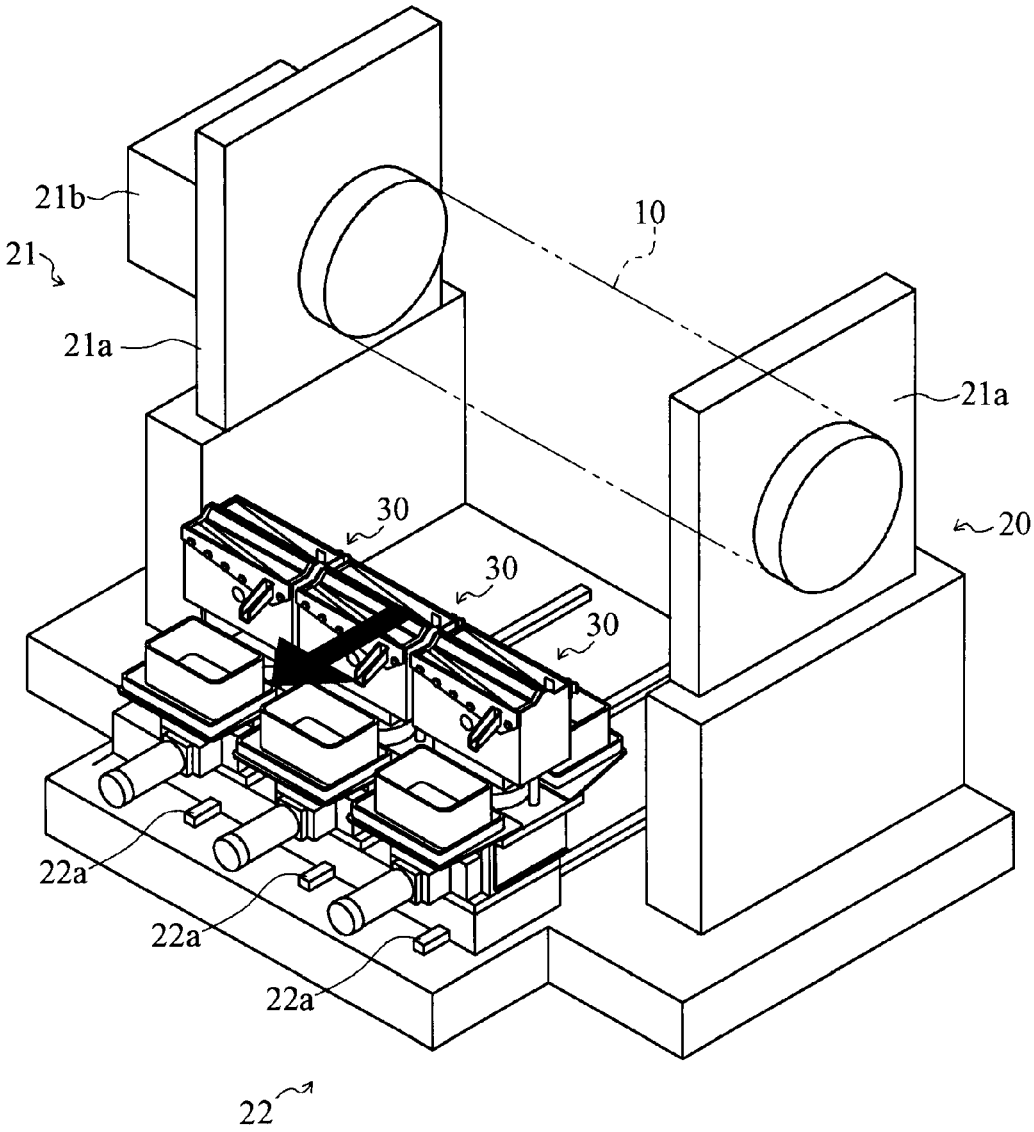
FIG. 2 shows a "separated position" of coating dies.
Figure 3:
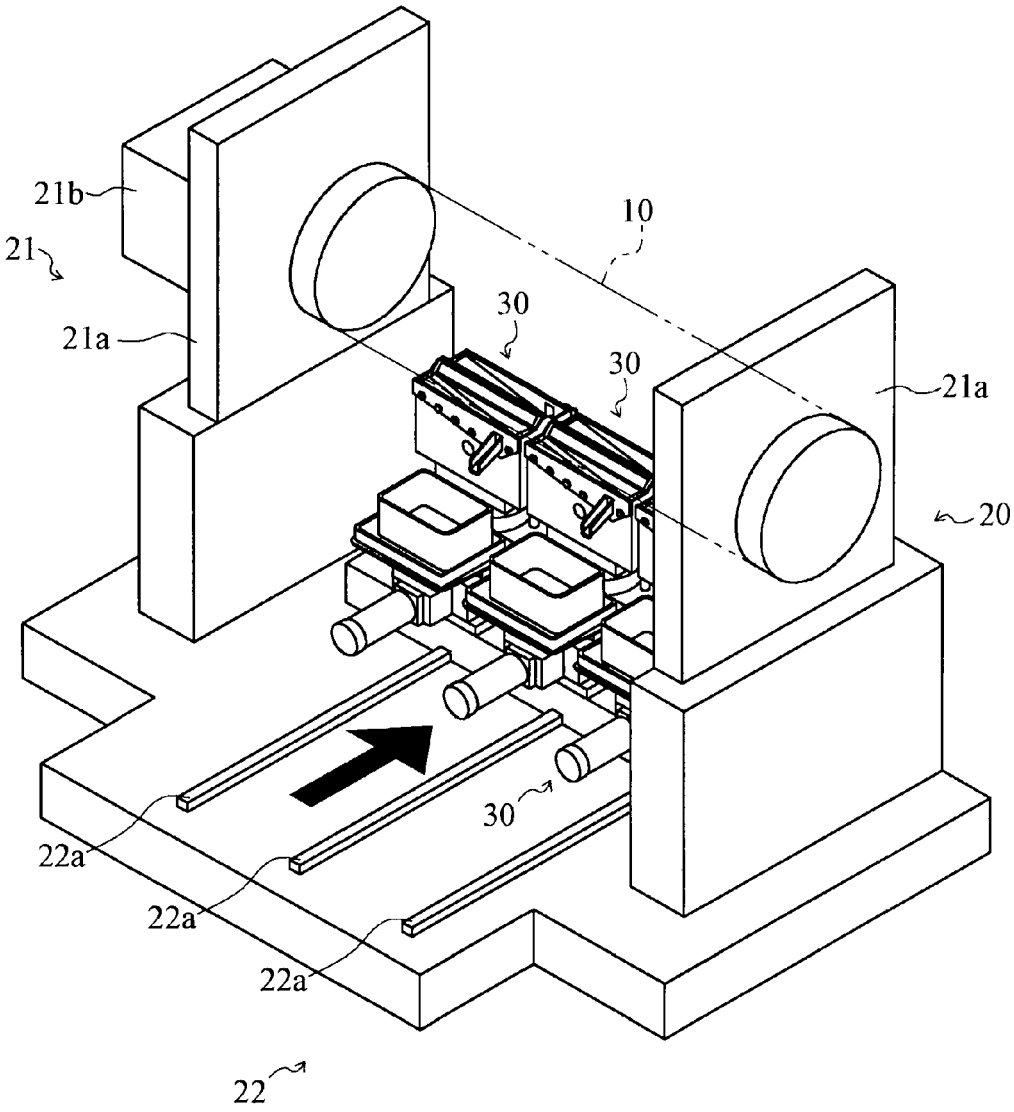
FIG. 3 shows a "coating position" of the coating dies.

Thus, the coating dies 30 are movable in the one plane direction (front-back direction) by predetermined distance, especially, as shown in FIGS. 2 and 3, the dies are movable between the position (hereinafter "separated position") separated from the roller 10 where is easy to clean or attach/detach the coating dies 30 and the position (hereinafter "coating position") below the roller 10 with facing the circumferential direction of the roller 10.

Figure 4:
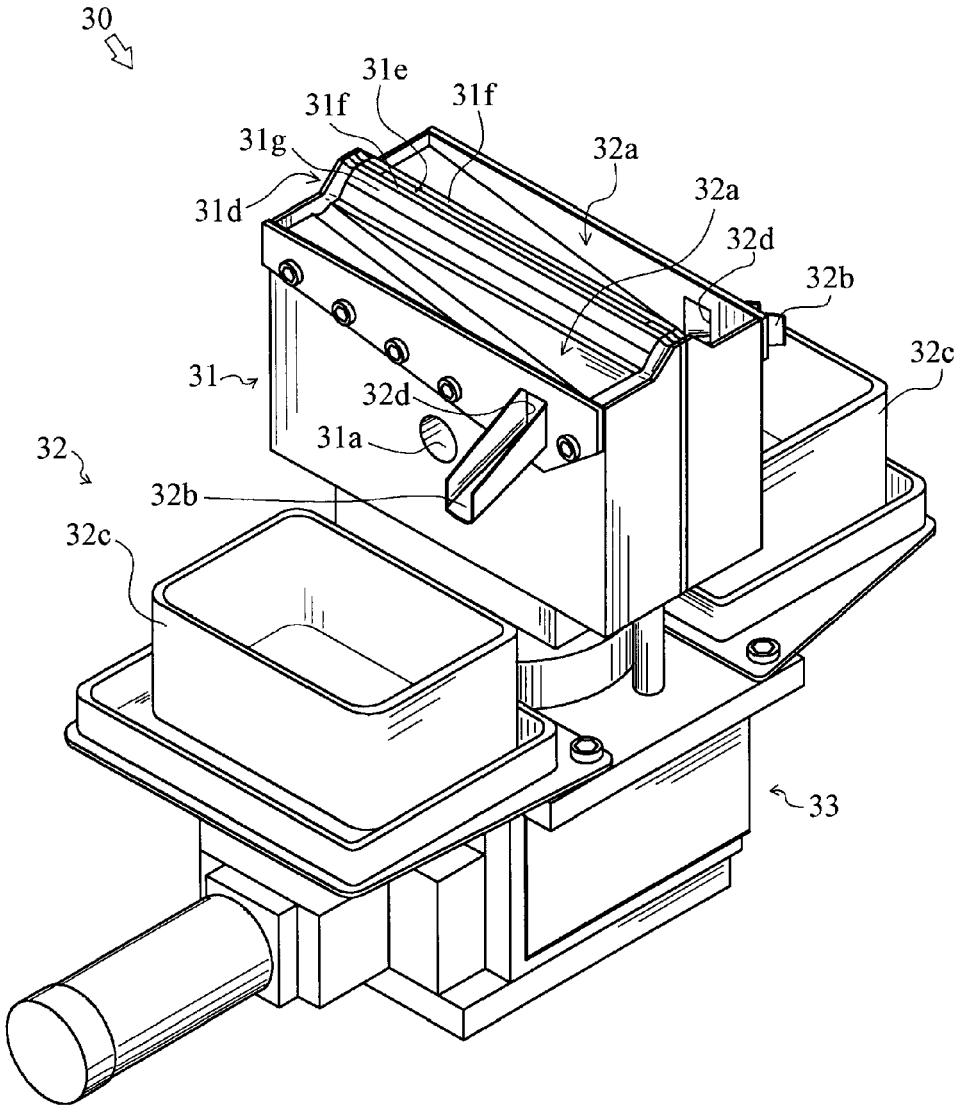
FIG. 4 depicts an enlarged perspective view of the coating die.

As depicted in FIG. 4, the coating die 30 includes a main body 31 discharging the paste 3 upwardly, recovery parts 32 for recovering the paste 3 to be flowed down from the main body 31 and an elevator device 33 for moving the main body 31 in the upper-lower direction. The coating die 30 discharges the paste 3 in the upper direction.

Figure 5:
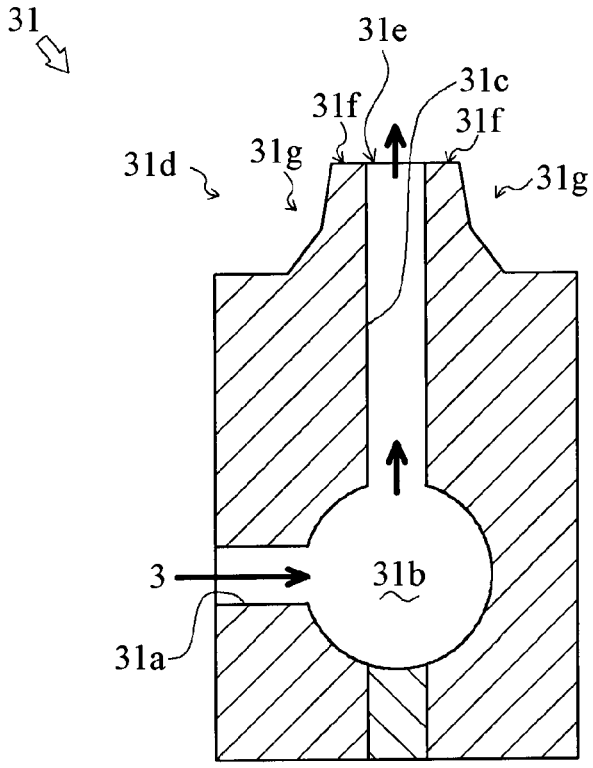
FIG. 5 is a section view illustrating a discharge path in the coating die.
Figure 6:
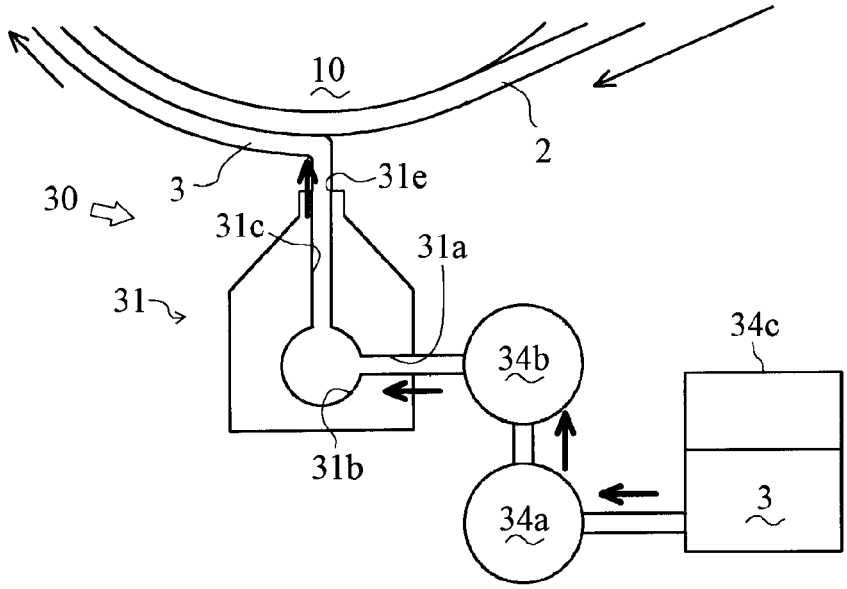
FIG. 6 illustrates a schematic view of a feeding path of a coating solution.

As illustrated in FIGS. 4 to 6, the main body 31 has a manifold 31*b* storing the paste 3 contemporarily and a discharge opening 31*e* for upwardly discharging the paste 3 stored in the manifold 31*b*.

The main body 31 includes a feeding path 31*a* connected with the manifold 31*b*, the manifold 31*b* storing the paste 3 fed into the main body 31, a slit 31*c* configured as a part of the discharge path of the main body 31 for discharging the paste 3, and a lip 31*d* arranged at the tip of the main body 31 for forming the discharge opening 31*e*.

The feeding path 31*a* is a passage communicating the inside to the outside of the main body 31, and is formed from the outer face of the main body 31 to the manifold 31*b* disposed inside thereof. The feeding path 31*a* is connected to a pump 34*a*, a valve 34*b*, and a tank 34*c*, both of which are the feeding sources of the paste 3 (see FIG. 6), and the paste 3 is fed into the main body 31 through the feeding path 31*a*.

The manifold 31*b* is formed inside of the main body 31 as the space that has the same width as the width in the left-right direction (coating width) of the discharge opening 31*e*, and connected with the one end (that is disposed inside the main body 31) of the feeding path 31*a*. The manifold 31*b* contemporarily stores the paste 3 fed into the main body 31, and in the manifold, the paste 3 fed through the feeding path 31*a* is broadened in the left-right direction in the main body 31.

The slit 31*c* is a space defined inside the main body 31, and formed upward from the manifold 31*b*. The slit 31*c* has the same width as the manifold 31*b* has, and guides the paste 3 that is stored and broadened in the left-right direction in the manifold 31*b* to the discharge opening 31*e*.

The lip 31*d* is formed at the end (upper end) of the main body 31, and has the discharge opening 31*e* which is opening upward. The discharge opening 31*e* has the same width as the manifold 31*b* and the slit 31*c* have, and disposed at the upper end of the slit 31*c*. The structure of the discharge opening 31*e* is an important matter to the coating quality, so that the opening area of the discharge opening 31*e* is rigorously adjusted in accordance with the coating configuration of the coating apparatus 1.

It should be mentioned that the feeding path 31*a* is arranged in the lower area of the main body 31 and opens at the center in the left-right direction. Thus, the paste is broad ened evenly in the left-right direction (longitudinal direction of the coating area) inside the manifold 31*b*.

The manifold 31*b* is apart from the discharge opening 31*e*. Therefore, the evenness of the paste 3 is maintained that travels from the manifold 31*b* to the discharge opening 31*e* via the slit 31*c*.

The discharge opening 31*e* is opening upward. This structure prevents air from mixing into the paste 3 when coating it.

As illustrated in FIG. 6, the end (outer end of the main body 31) of the feeding path 31*a* is connected to the tank 34*c* storing the paste 3 through the pump 34*a* for feeding the paste 3 to the main body 31 and the valve 34*b* for adjusting the feeding volume of the paste 3, and the other end of the feeding path 31*a* is connected to the manifold 31*b*.

The valve 34*b* is a conventional on-off valve, and the pump 34*a* is a conventional metering pump. These valve 34*b* and the pump 34*a* are controlled with high accuracy by a controller. For example, the discharge volume of the pump 34*a* is controlled in response to the rotation speed of the back-up roller 10, thereby adjusting the coating thickness of the paste 3 fed from the pump 34*a* on the web 2.

In the coating die 30, the feeding passage is configured in the following order: the tank 34*c*, the pump 34*a*, the valve 34*b*, the manifold 31*b*, the slit 31*c*, and the discharge opening 31*e*. The paste 3 is fed along the feeding passage at the predetermined volume in the predetermined time. Thus, the paste 3 contemporarily stored in the manifold 31*b* is discharged from the discharge opening 31*e* of the lip 31*d*.

As illustrated in FIGS. 4 and 5, the lip 31*d* is formed such that the tip thereof is projected upward, and the discharge opening 31*e* is disposed at the tip. The lip includes top surfaces 31*f* defining the discharge opening 31*e* and inclined surfaces 31*g* continuously connected to the top surfaces 31*f*. The paste 3 flowed out from the discharge opening 31*e* drips down along the top surfaces 31*f* and the inclined surfaces 31*g*.

As depicted in FIG. 4, the recovery parts 32 are attached to the main body 31 that are arranged symmetry with respect to the discharge opening 31*e*, and recovery the paste 3 flowed out from the discharge opening 31*e* of the main body 31.

The recovery part 32 includes a groove 32*a* for collecting the paste 3 to a predetermined portion, a shoot 32*b* for discharging the paste 3 collected by the groove 32*a* and a recovery pan 32*c* for recovering the paste 3 discharged through the shoot 32*b*.

The grooves 32*a* are configured in the upper portion of the lip 31*d* (namely, to surround the periphery of the discharge opening 31*e*) and configured as the flow passages having bottoms inclined downwardly toward a predetermined position (apart from the feeding path 31*a* in plan view). The groove 32*a* has inclined faces, which are formed at the both ends in the front-back direction of the discharge opening 31*e* and continued from the bottom of the inclined surface 31*g* of the lip 31*d*, and has inclined faces, which are formed at the both ends in the left-right direction of the discharge opening 31*e* and extended toward the left-right direction from the discharge opening 31*e*. The grooves 32*a* are formed at the both sides in the front-back direction of the top surface of the main body 31, and the groove has the shape inclined toward the middle portion in the left-right direction oriented by a predetermined distance to the one side of the left or right side (in this embodiment, right side).

The shoots 32*b* are the flow passages having bottoms to discharge the paste 3 guided along the grooves 32*a* to the outside of the grooves 32*a*. The groove 32*a* inclined downward has an opening 32*d* at the bottom end to communicate the inside of the groove 32*a* with the outside, and the bottom of the shoot 32*b* is connected continuously to the bottom of the groove 32*a* via the opening 32*d*. The shoot 32*b* is extended outward of the main body 31 from the opening 32*d*. The shoot 32*b* is inclined downwardly toward the outer end thereof.

The recovery pan 32*c* is a container having an enough volume and disposed below the outer end of the shoot 32*b*. The recovery pan 32*c* receives the paste 3 flowed down through the groove 32*a* and the shoot 32*b* with the action of gravity. The recovery pan 32*c* is mounted on the elevator device 33.

Figure 7:
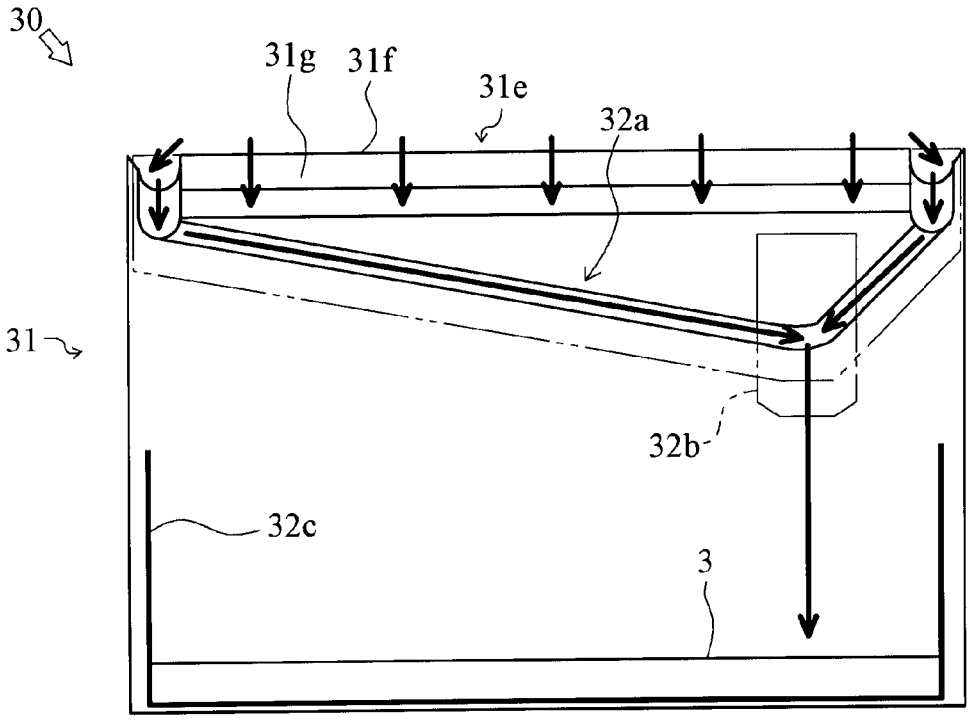
FIG. 7 illustrates a flow of the coating solution in the coating die.

As described above, in the coating die 30, the paste 3 flowing out from the discharge opening 31*e* goes along the inclined grooves 32*a* and is guided to the shoots 32*b*, whereby the paste drops through the shoots 32*b* into the recovery pans 32*c* and is recovered (referring to FIG. 7).

The paste 3 thus recovered in the recovery pans 32*c* is wasted or reused after processing for reuse.

As shown in FIGS. 3 and 4, the elevator device 33 keeps the main body 31 horizontal and positions the main body 31 at a predetermined location in the upper-lower direction.

The elevator device 33 supports the main body 31 and the recovery parts 32 directly or indirectly. The elevator devices 33 are detachably mounted on the sliding device 22, which are spaced by a predetermined distance each other. The elevator device 33 has an actuator that is controlled with high accuracy, and the location of the main body 31 (namely, the location of the discharge opening 31*e*) in the upper-lower direction is highly accurately decided with the actuator.

Thus, in each elevator device 33, the actuator is operated when the coating die 30 is located in "coating position", so that each coating die 30 can perform fine positioning of the distance between the discharge opening 31*e* of the main body 31 and the back-up roller 10 (that is the distance between the discharge opening 31*e* and the web 2). Therefore, the coating apparatus 1 provides the stable coating quality.

Referring to FIG. 7, preparation process for the coating die 30 when starting the coating with the coating apparatus 1 is described. In this time, each coating die 30 is located in the coating position.

Before coating (in an initial state), the paste 3 is not filled in the feeding passage of the coating die 30 (referring to FIG. 6, the passage through the tank 34*c*, the pump 34*a*, the valve 34*b*, the manifold 31*b*, the slit 31*c* and the discharge opening 31*e*). So, in the preparation process before coating in order to prevent the air from mixing in the paste 3, the paste 3 is filled up in the feeding passage to deaerate.

When filling up the paste 3 and deaerating, the paste 3 is continuously discharged from the discharge opening 31*e*, and the paste 3 is dripped down from the discharge opening 31*e* of the lip 31*d*.

As illustrated in FIG. 7, the paste 3 flowing down from the discharge opening 31*e* runs along the top surfaces 31*f* and the inclined surfaces 31*g* to the grooves 32*a*. The paste 3 flowed to the grooves 32*a* is collected in the recovery pans 32*c* via the shoots 32*b*.

The coating die 30 includes the main body 31 discharging the paste 3, the recovery pans 32*c* for recovering the paste 3 flowed down from the discharge opening 31*e* of the main body 31, the grooves 32*a* and the shoots 32*b* as the guides for the paste 3 through the recovery pans 32*c*.

This structure provides the good recovery for the paste 3 that is flowed down from the discharge opening 31 e during the preparation process. Further, the paste 3 is prevented from attaching to the peripheral members of the coating dies 30 of the coating apparatus 1, and therefore the web 2 is prevented from suffering from the foreign matter. Thus, the coating apparatus 1 maintains the good coating quality, and the peripheral members are prevented from damage.

Moreover, in the case that the paste 3 is attached to the any portion of the coating dies 30 and dried off, the coating dies 30 are moved to the separated position from the coating position by using the sliding device 22 and the coating dies can be cleaned and washed independently, thereby improving the efficiency of cleaning. In other words, the cleaning efficiencies for the coating dies 30 are enhanced.

Especially in the case that the web 2 is the electrode web of the battery, the foreign matter attached around the discharge opening 31*e* of the coating die 30 is prevented from mixing into the paste. Therefore, it is possible to maintain the product quality of the battery including the web 2 coated with the paste 3 that is the electrode compound.

In each coating die 30, the distance between the discharge opening 31*e* and the back-up roller 10 is adjustable by using the elevator device 33, and therefore, the coating die 30 is easy to fine adjust the position thereof and it is easy to maintain the evenness of the coating thickness of the paste 3. Especially in the coating apparatus 1 containing multiple coating dies 30, it is easy to adjust the coating condition of the paste 3 in each coating die 30, so that the high coating performance is stably obtained.

Further, each coating die 30 has the recovery equipment, that is, the main body 31 is installed with the recovery parts 32, so that there is no need to prepare a separate recovery device for the paste 3 flowed down from the discharge opening 31*e*.

It should be noted that the web 2 is not limited to the electrode web and the web may be a common object to be coated, and the paste 3 is not limited to the electrode compound and the paste may be a common coating solution.

In this embodiment, the coating apparatus 1 includes three coating dies 30, but the number or the coating width of the coating die 30 may be changeable in accordance with the coating condition for the web 2.

The sliding device 22 moving the coating dies 30 in the front-back direction is used to move the coating dies 30 integrally, but the sliding device may move them separately. In the case, the each sliding guide 22*a* has the driving device for actuating the sliding device.

The coating dies 30 are arranged in the circumferential direction of the back-up roller 10, and the discharge direction through the discharge opening 31*e* of the coating die 30 is set as the radius direction of the back-up roller 10. The coating dies 30 and the back-up roller 10 may be set in the arrangement shown in FIG. 8.

Figure 8:
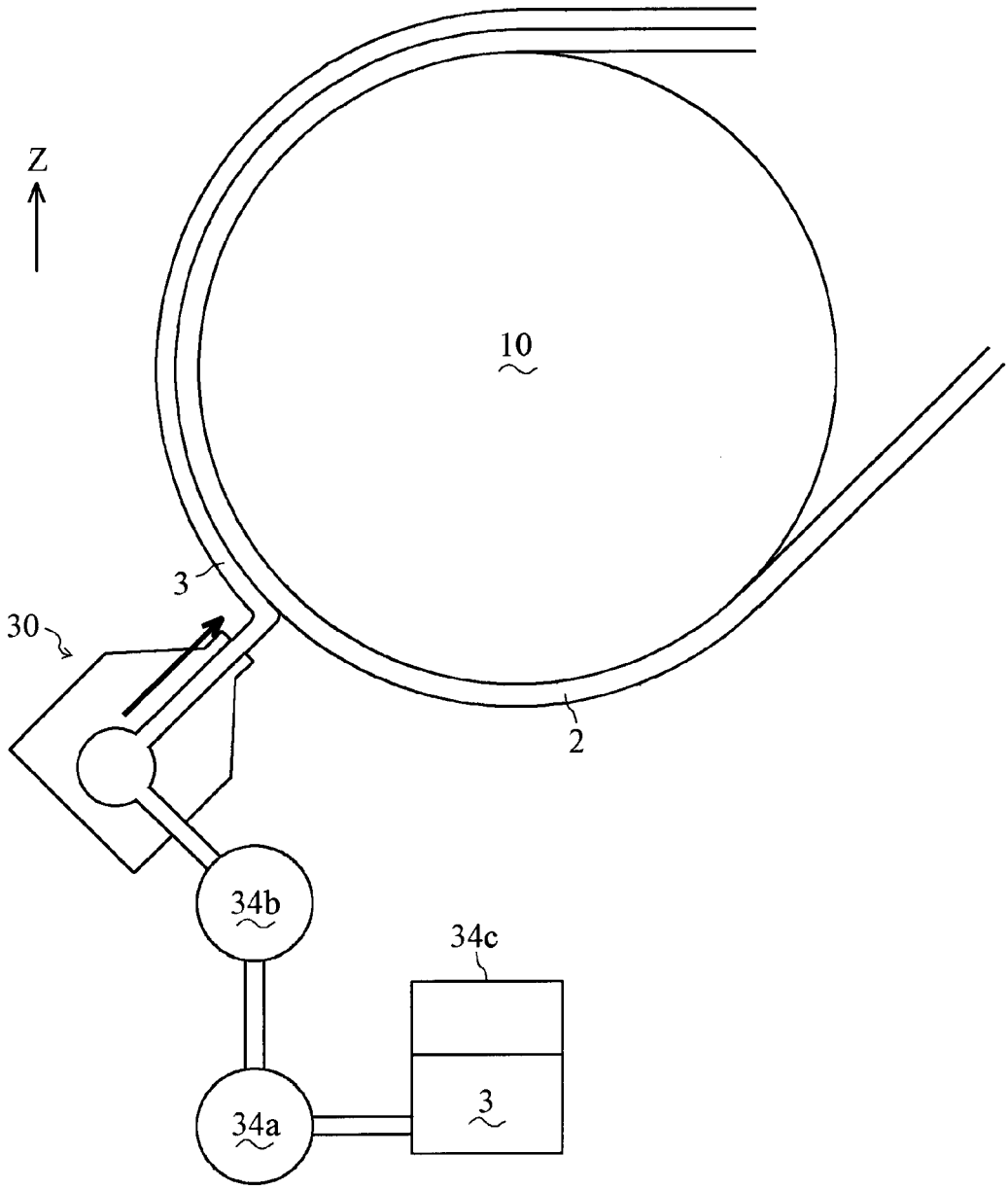
FIG. 8 illustrates a schematic view of another embodiment of the coating apparatus.

In the arrangement shown in FIG. 8, the coating dies 30 discharge the paste 3 in the obliquely upward. In this embodiment, the sliding device 22 moves the coating dies 30 such that the coating dies are close to or separated from the back-up roller 10, and the elevator devices 33 elevate the coating dies 30 such that the distance between the discharge openings 31*e* of the coating dies and the surface of the web 2 is adjustable.

The recovery parts 32 may be disposed at least in one side where gravity acts on the paste 3 discharged from the discharge opening 31*e* (namely, in the lower side), and in the embodiment shown in FIG. 8, the recovery parts may be provided only lower side, which makes the number of members reduced.

Industrial Applicability

The present invention is applicable to a coating apparatus for coating a coating solution on a surface of a sheet member, and especially to a technique of recovering the coating solution flowed out during a preparation step.

The invention claimed is:

1. A coating apparatus comprising multiple coating dies for coating a coating solution on an object to be coated, wherein each of the coating dies comprises:

a main body comprising a discharge opening for discharging the coating solution upwardly;

a recovery container for recovering the coating solution flowed down from the discharge opening;

a flow passage formed integrally with the main body, guiding the coating solution to the recovery container; and an elevator device for moving the main body in an upper-lower direction so as to fine adjust a distance between the discharge opening of the main body and the object to be coated, wherein the flow passage comprises:

a groove having a bottom, formed around the discharge opening, inclined toward a predetermined position; and a shoot having a bottom, formed continuously from the groove, discharging the coating solution guided along the groove to outside of the groove, and wherein the coating apparatus further comprises:

a conveyor for conveying the object to be coated continuously with a surface thereof facing to the discharge openings of the coating dies; and a supporter for supporting the coating dies movable separately from each other in a direction perpendicular to the upper-lower direction within a state where each of the coating dies faces to the surface of the object to be coated and a state where each of the coating dies is separated from the object to be coated.

* * * * *